US006412169B1

(12) United States Patent
Endo et al.

(10) Patent No.: US 6,412,169 B1
(45) Date of Patent: Jul. 2, 2002

(54) DEVICE FOR MOUNTING REAR HOLDER IN CONNECTOR AND METHOD FOR MOUNTING REAR HOLDER

(75) Inventors: Takayoshi Endo; Yuji Hatagishi; Kimihiro Abe, all of Shizuoka (JP)

(73) Assignee: Yazaki Corp., Tokyo (JP)

( * ) Notice: Subject to any disclaimer, the term of this patent is extended or adjusted under 35 U.S.C. 154(b) by 0 days.

(21) Appl. No.: 09/514,159

(22) Filed: Feb. 28, 2000

Related U.S. Application Data

(62) Division of application No. 09/134,868, filed on Aug. 17, 1998.

(30) Foreign Application Priority Data

Aug. 19, 1997 (JP) ..... 9-222337

(51) Int. Cl.[7] ..... H01R 43/20

(52) U.S. Cl. ..... 29/876; 29/874; 29/884; 439/596

(58) Field of Search ..... 29/825, 874, 884, 29/729, 750, 753, 754; 439/596; 7/107; 30/274, 290, 289; 83/648, 651, 631.1, 701

(56) References Cited

U.S. PATENT DOCUMENTS 5,662,487 A * 9/1997 Okamura et al. ..... 29/876
5,716,235 A * 2/1998 Endo et al. ..... 439/596
5,827,093 A 10/1998 Okabe ..... 439/596

FOREIGN PATENT DOCUMENTS

JP 2-49656 12/1990

* cited by examiner

*Primary Examiner*—Carl J. Arbes
(74) *Attorney, Agent, or Firm*—Armstrong, Westerman & Hattori, LLP

(57) ABSTRACT

In a connector equipped with a rear holder, the rear holder in an open state is coupled with a housing of the connector by a fixing belt. A rear holder mounting device is provided with a cutter and slide bar. The cutter is moved to cut the fixing belt. The slide bar is moved to close the rear holder so that the rear holder is engaged in the housing. Thus, working before mounting the rear holder in the connector can be smoothly carried out. The rear holder, without being damaged or deformed, can be easily mounted in the connector.

7 Claims, 8 Drawing Sheets

DEVICE FOR MOUNTING REAR HOLDER IN CONNECTOR AND METHOD FOR MOUNTING REAR HOLDER

This is a division of application Ser. No. 09/134,868, filed on Aug. 17, 1998.

BACKGROUND OF THE INVENTION

Field of the Invention

The present invention relates to a connector equipped with a rear holder which is closably coupled with a housing through a thin hinge belt, a rear holder device for automatically mounting the rear holder in the hosing, and a method of mounting the rear holder.

Description of the Related Art

A previously known connector equipped with a rear holder is proposed in J-UM-Publn. 2-49656 and shown in FIGS. 8A–8C. FIG. 8A is a side sectional view; FIG. 8B is a front view and FIG. 8C is a side view of the main part.

In these drawings, within a housing 110, two (upper and lower) stages of terminal chambers 111 each for accommodating a terminal 130 are provided. Within each terminal chamber 111, a terminal securing arm 112 for securing the terminal 130 is provided.

A rear holder 120 is closably coupled with the housing 110 through a thin hinge belt 113.

A stopper 121 is formed on the lower side of the tip of the rear holder. The stopper 120 is provided for doubly securing the terminal 130 within the terminal chamber 111. An engaging portion 122 is formed on the upper side of the tip. The engaging portion 122 serves to mount the rear holder 120 in the housing 120.

In the above connector equipped with a rear holder, with the rear holder 120 being in a free state, the terminal 130 with an electric wire crimped is inserted into each terminal chamber 130 of the housing 110. Then, the terminal 130 is secured in each terminal chamber 111 by the terminal securing arm.

Thereafter, when the rear holder 120 is mounted in the housing 110, the terminal 130 is doubly secured within each terminal chamber 111.

The above related art connector equipped with the rear holder has the following disadvantage. The rear holder, which is in a free state before the rear holder 120 is mounted in the housing 110, may obstruct the working step prior to mounting the rear holder, such as insertion of the terminal 130 equipped with an electric wire.

The electric wire may be caught on the rear holder in the free state. This may lead to deformation and damage in the rear holder 120.

SUMMARY OF THE INVENTION

A first object of the present invention is to provide a connector equipped with a rear holder, which can smoothly carry out the working steps prior to mounting a rear holder, surely prevent deformation and breakage of the rear holder and permits the rear holder to be easily mounted in the housing.

A second object of the present invention is to provide a rear holder mounting device having such capability.

A third object of the present invention is to provide a method of mounting the rear holder having the above capability.

In order to attain the first object, in accordance with the present invention, there is provided a connector equipped with a rear holder comprising: a thin hinge belt for closably coupling the rear holder with a housing; and a fixing belt for coupling the rear holder with the said housing in its open state, the fixing belt being formed integrally to the rear holder and housing.

In this configuration, before the fixing belt is cut, i.e., the rear holder is mounted, the rear holder can be held in an opened state and hence is not an obstacle. For this reason, the respective working steps prior to mounting the rear holder can be smoothly executed.

During each working step, the electric wire is not caught by the rear holder so that the rear holder is surely prevented from being damaged and deformed.

In order to attain the second object, there is provided a device for mounting the rear holder in the connector in the connector equipped with a rear holder comprising: a cutter body equipped with a cutting blade which can be inserted in between the rear holder in an open state and said housing; and a pair of frames holding both sides of said connector so that the rear holder is closable and having guide grooves which serve to position the cutting blade on the fixing belt of the connector held at a holding position, and guide the cutter retractably for the connector.

Preferably, the device for mounting the rear holder further comprises a slide bar provided slidably on the cutter body and having a guide slope to be brought into contact with said rear holder.

In such a configuration, with the rear holder held on the one side of the guide grooves of the frames, the cutter body is advanced toward the rear holder form the other end of the guide grooves so that the fixing belt can be easily cut. In addition, at the same time as the fixing belt is cut, the rear holder is placed in a free state, and hence can be mounted in the housing.

In order to attain the third object, in the rear holder mounting device, there is provided a method for mounting a rear holder in a connector in the device for mounting the rear holder in the connector comprising the steps of: holding the connector in the grooves and attaching the cutter body to the grooves; advancing the cutter body along the guide grooves to cut the fixing belt of the connector equipped with the rear holder; advancing the slide bar to rotate the rear holder in its closing direction; and closing the rear holder to be engaged in said housing.

In such a configuration, after the fixing belt is cut, the rear holder can be rotated in a closing direction, preferably using the guiding slope of the slide bar. For this reason, it can be mounted simply in the housing.

The above and other objects and features of the present invention will be more apparent from the following description taken in conjunction with the accoppanying drawings.

DESCRIPTION OF THE PREFERRED EMBODIMENTS

Figure 1A:
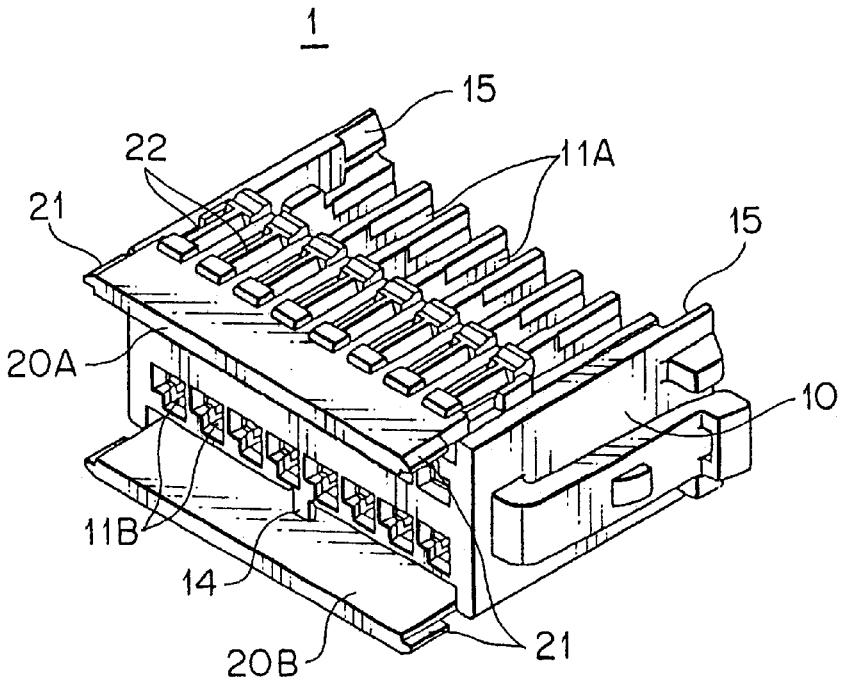
FIGS. 1A and 1B are perspective views of a connector equipped with a rear holder according to one embodiment of the present invention.
Figure 1B:
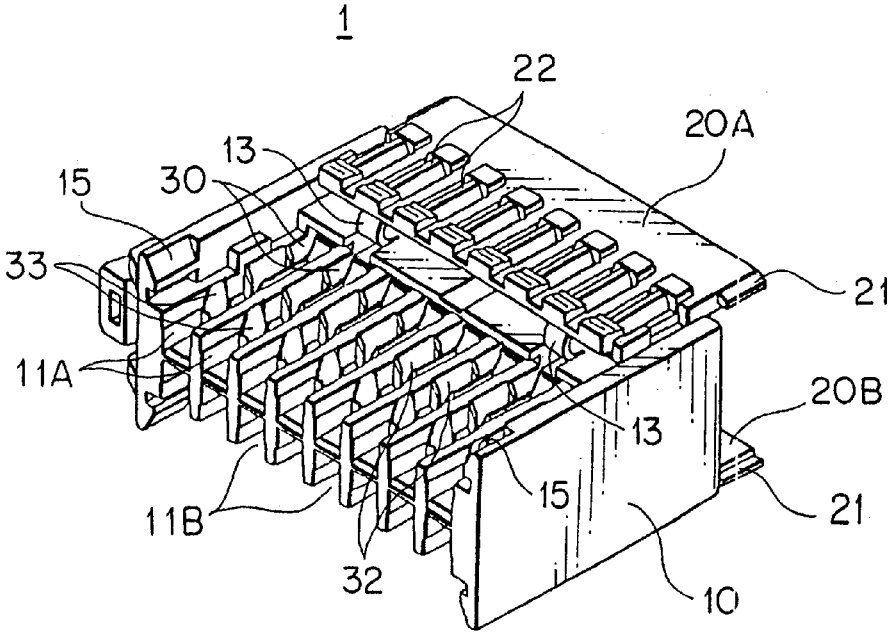

An explanation will be given of embodiments of a connector equipped with a rear holder, a rear holder mounting device and a rear holder mounting method according to the present invention.

Embodiment 1

An explanation will be given of the first embodiment of the present invention.

As seen from FIGS. 1A, 1B and FIGS. 2A, 2B, a connector equipped with a rear holder is structured into two, i.e. upper and lower stages each having a plurality of terminal chambers 11A, 11B within a housing 10. Each terminal chamber 11A (11B) is provided with a securing protrusion which is secured to a securing piece 31 of a terminal 30 which will be described later.

On each of the upper and lower surfaces of the housing 10, rear holder 20A (20B) corresponding to the terminal chambers 11A (11B) are formed continuously through thin hinge belts 13, respectively.

These rear holder 20A (20B) can be essentially opened or closed by the hinge belts. However, before the terminal 30 is assembled into the terminal chamber 11A (11B), these rear holder 20A (20B) is coupled with the housing 10 through fixing belt 14 and fixed in the fixed state.

Locking pieces 21 are protruded from both sides of the rear holder 20A (20B). When the rear holder 20A (20B) is closed by cutting the fixing belt 14, these locking pieces 21 are engaged with locking pieces 15, respectively so that the rear holder 20A (20B) is mounted on the housing 10.

A plurality of holding ribs 22 corresponding to the terminal chambers 11A (11B) are protruded from the underside of the rear holder 20A (20B).

The holding ribs 22 each is formed in an wedge shape corresponding to the V-shape recess of each of the contact pieces of the terminal 30. When the rear holder 20A (20B) is in the closed state, the holding rib 22 is caught in the V-shape recess of the contact piece 32 to hold the terminal 30.

The terminal (female terminal) 30 is formed by cutting up a metallic plate, and is composed of the aforementined securing piece 31, contact piece 32 cutting into the covering of a press-fit wire and crimped with the core thereof, and caulking portion 33 for holding the wire pressure-contact with the contact piece 32.

Figure 3:
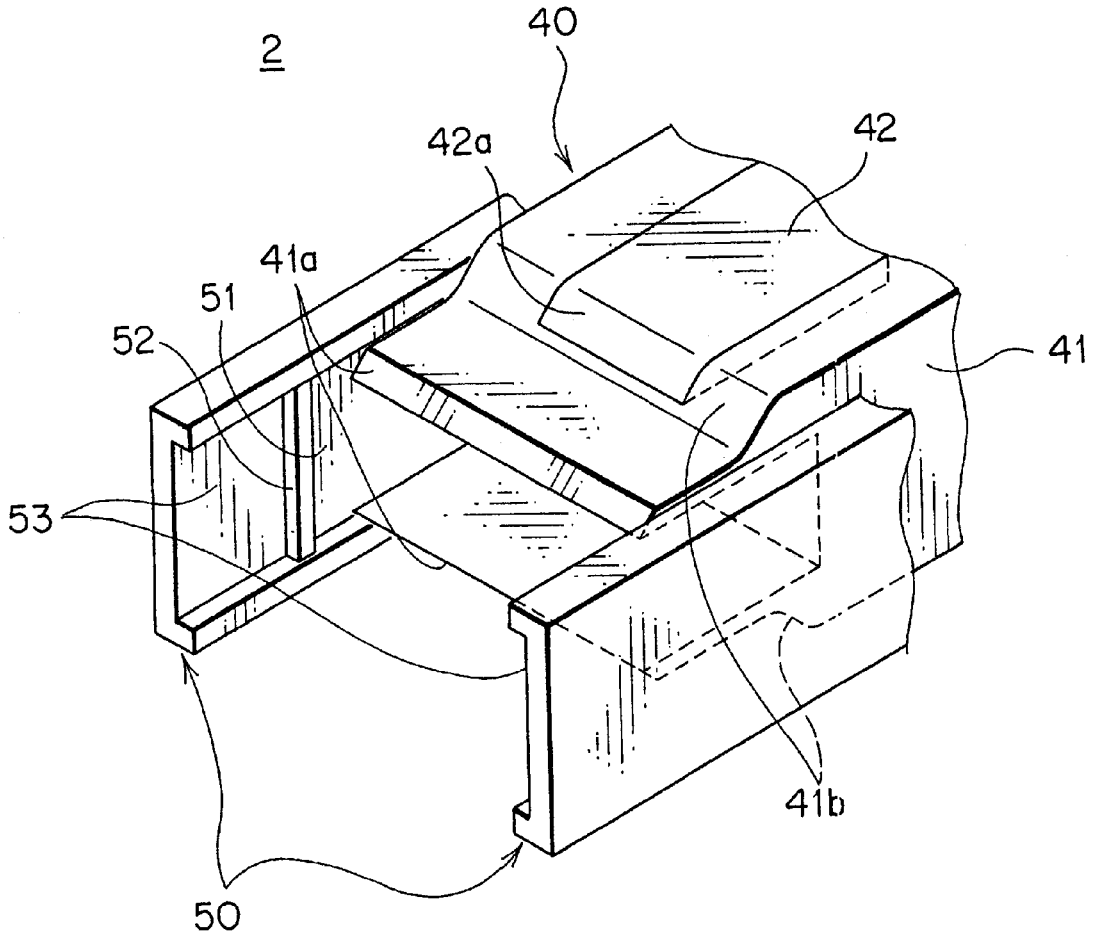
FIG. 3 is a perspective view of the main part of a rear holder mounting device according to the first embodiment of the present invention.

In FIG. 3, a rear holder mounting device 2 according to this embodiment includes a cutter 40 which is shifted by a driving system (not shown) and a pair of frames 50 which serve to hold the connector equipped with the rear holder and guide the cutter 40 toward the connector 1 equipped with the rear holder 1.

The cutter 40 is composed of a bar-like body 41 having an upper and lower symmetrical bifurcated tips and a slide bar 42 having a shape conforming to the outer shape of the bar-like body 41.

The body 41 can be shifted along the guide grooves 51 of the frames 50. The bifurcated tip thereof is formed to be thinner forwardly. The bifurcated tip is provided with a cutting blade 41*a* which can be passed between the rear holder 20A (20B) in the opened state and the housing 10.

The slide bar 42 is slidable along the body 41, and has bifurcated tips each provided with guide slope 42*a* to be in contact with the rear holders 20A and 20B in the opened state.

Additionally, in this embodiment, the bifurcated tips of the body 41 each is also provided with the guide slope 41*b* integral to the guide slope 42*a* of the slide bar 42.

On the other hand, the frames 50 each has a strip of guide groove 51 on its internal face. The guide grooves 51 each is partitioned on its one side to form a holding portion 53 of the connector equipped with the rear holder.

The holding portions 53 serve to hold both sides of the housing 10 of the connector 1 so that the rear holders 20A and 20B can be opened or closed.

The guide grooves 51 serve to position the cutting blades 41*a* of the cutter 40 on the fixing belts 14 on the of the connector held in the holding portions 53, and guide the cutter 40 retractably for the connector 1.

Now referring to FIGS. 4 and 5, an explanation will be given of a method of mounting a rear holder according to the first embodiment of the present invention.

Figure 4A:
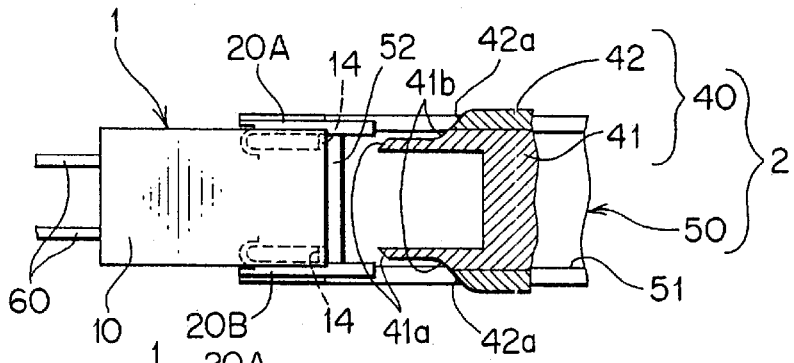
FIGS. 4A–4E are sectional step views showing a sequential process of mounting the rear holder according to the first embodiment.
Figure 4B:
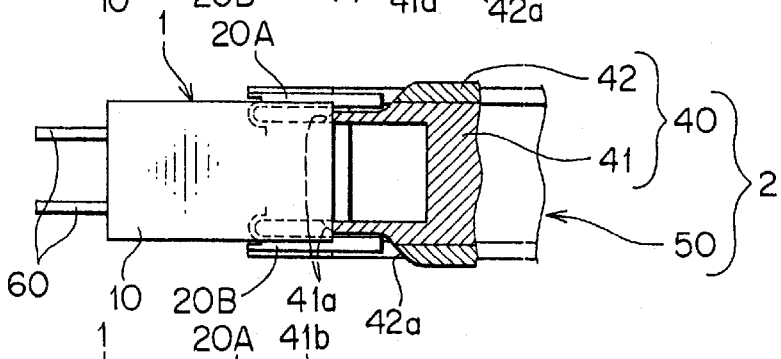
Figure 4C:
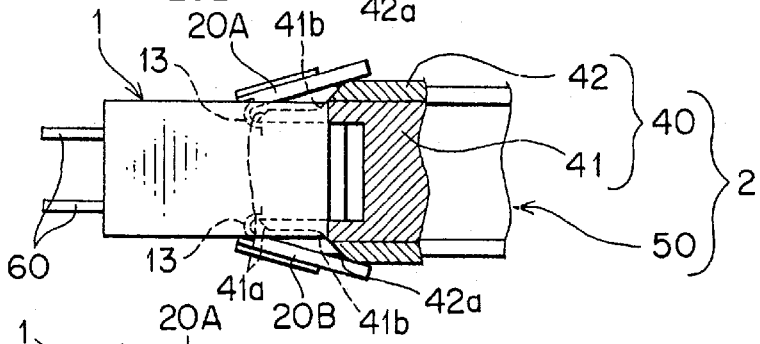

FIGS. 4A to 4C are sectional views of a process for mounting a rear holder according to the first embodiment.

As shown in FIG. 4A, the holding portions 53 of the frames 50 of the rear holder mounting device 2 are set in the connector 1, and thereafter, the cutter 40 is advanced by a driving system (not shown).

Then, as shown in FIG. 4B, the cutting blades 41*a* of the cutter 40 are inserted in between the rear holders 20A, 20B in an opened state and the housing 10 so that the fixing belts 14 fixing the rear holders 20A and 20B are cut. Thus, the rear holders 20A and 20B fall into the free state.

As shown in FIG. 4C, the cutter 40 is stopped before hinge belts 13.

Thus, the ends of the rear holders 20A and 20B are ridden over the guide slopes 41*b* and 42*a*. As a result, sliding bars 42 enter below the rear holders 20A and 20B, respectively.

Only the slide bars 42 are advanced by operating the driving means (not shown).

Figure 4D:
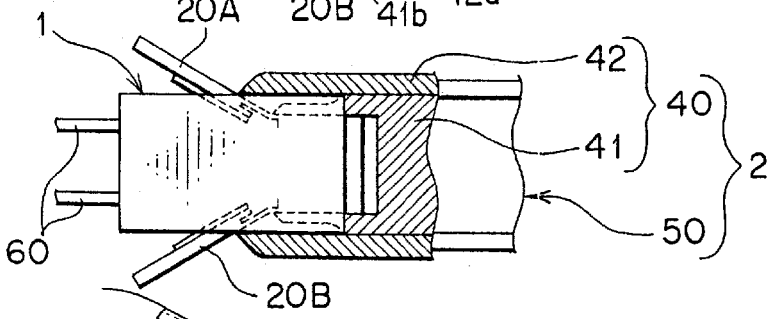
Figure 5A:
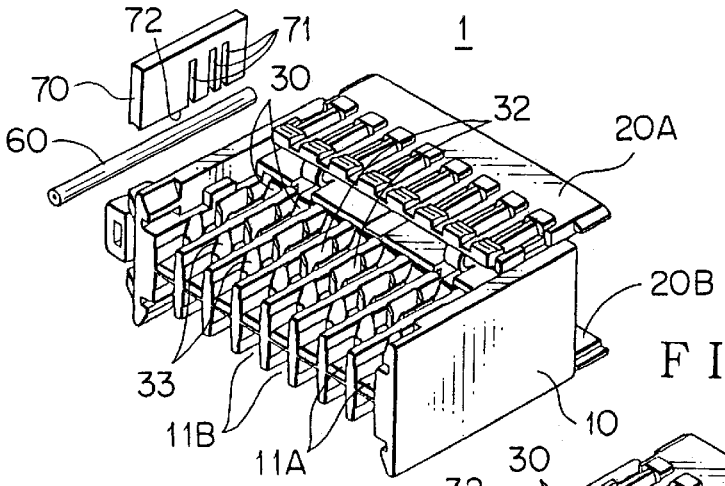
FIGS. 5A–5D are perspective views showing the connector equipped with the rear holder in performing the method of mounting the rear holder according to the first embodiment of the present invention.
Figure 5B:
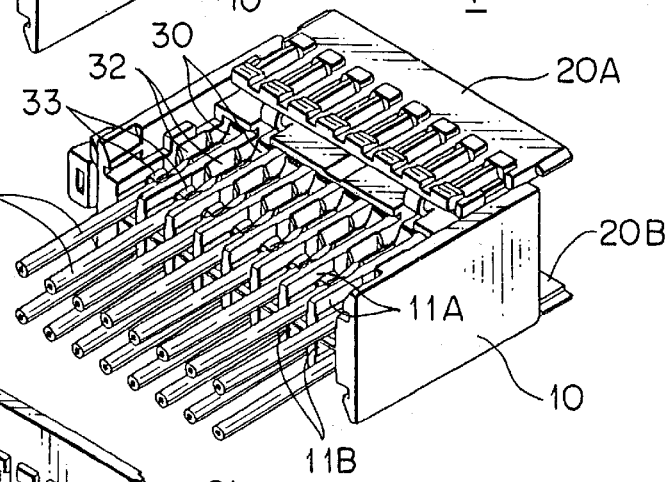
Figure 5C:
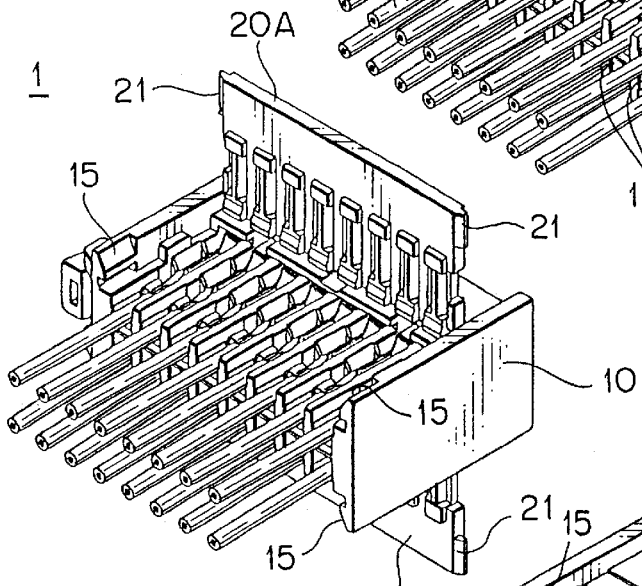

Then, as shown in FIGS. 4D and 5C, the slide bars 42 rotate the rear holders 20A and 20B in contact with the guide slopes 42*a* in their closing direction.

Figure 4E:
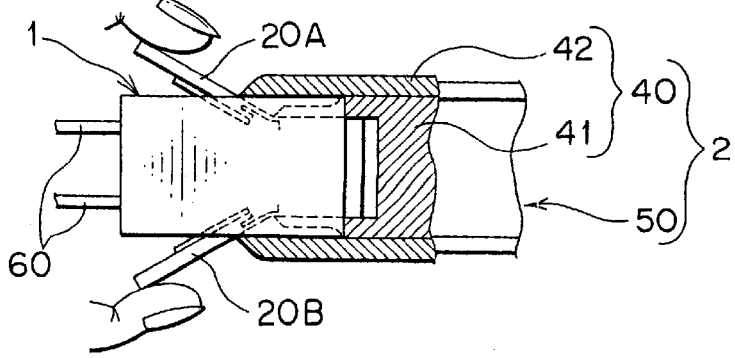

As shown in FIG. 4E, the slide bars are stopped. A worker pinches the rear holders 20A and 20B between his thumb and index finger so that they are completely closed.

Figure 5D:
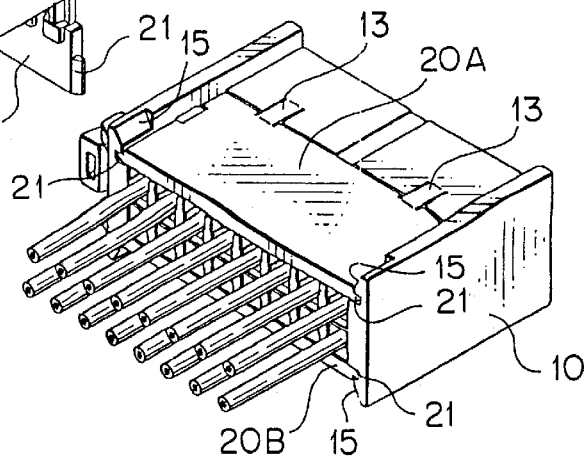

Thus, as shown in FIG. 5D, the locking pieces 21 of the rear holders 20A and 20B are engaged with the locking pieces 15 of the housing 10 so that the rear holders 20A and 20B are mounted in the housing 10.

In this way, in the connector 1 equipped with the rear holder according to this embodiment, before the fixing belts 14 are cut, i.e., the rear holders 20A and 20B are mounted, these rear holders can be held in an open state and hence are not an obstacle. For this reason, the respective working steps before the rear holders 20A and 20B are mounted can be smoothly executed.

During each of the working steps, electric wires 60 are not caught by the rear holders 20A and 20B so that the rear holders 20A and 20B are surely prevented from being damaged and deformed.

Further, in accordance with the device and method of mounting the rear holder according to this embodiment, after the fixing belts 14 are cut, the rear holders 20A and 20B can be rotated in a closing direction using the guiding slopes 42*a* of the slide bars 42. For this reason, they can be mounted simply in the housing 10.

In addition, in accordance with the rear holder mounting device and method, the respective fixing belts 14 of the rear holders 20A and 20B can be cut simultaneously and the rear holders 20A and 20B can be also closed simultaneously. Thus, the number of man-hours can be reduced.

Embodiment 2

Figure 6:
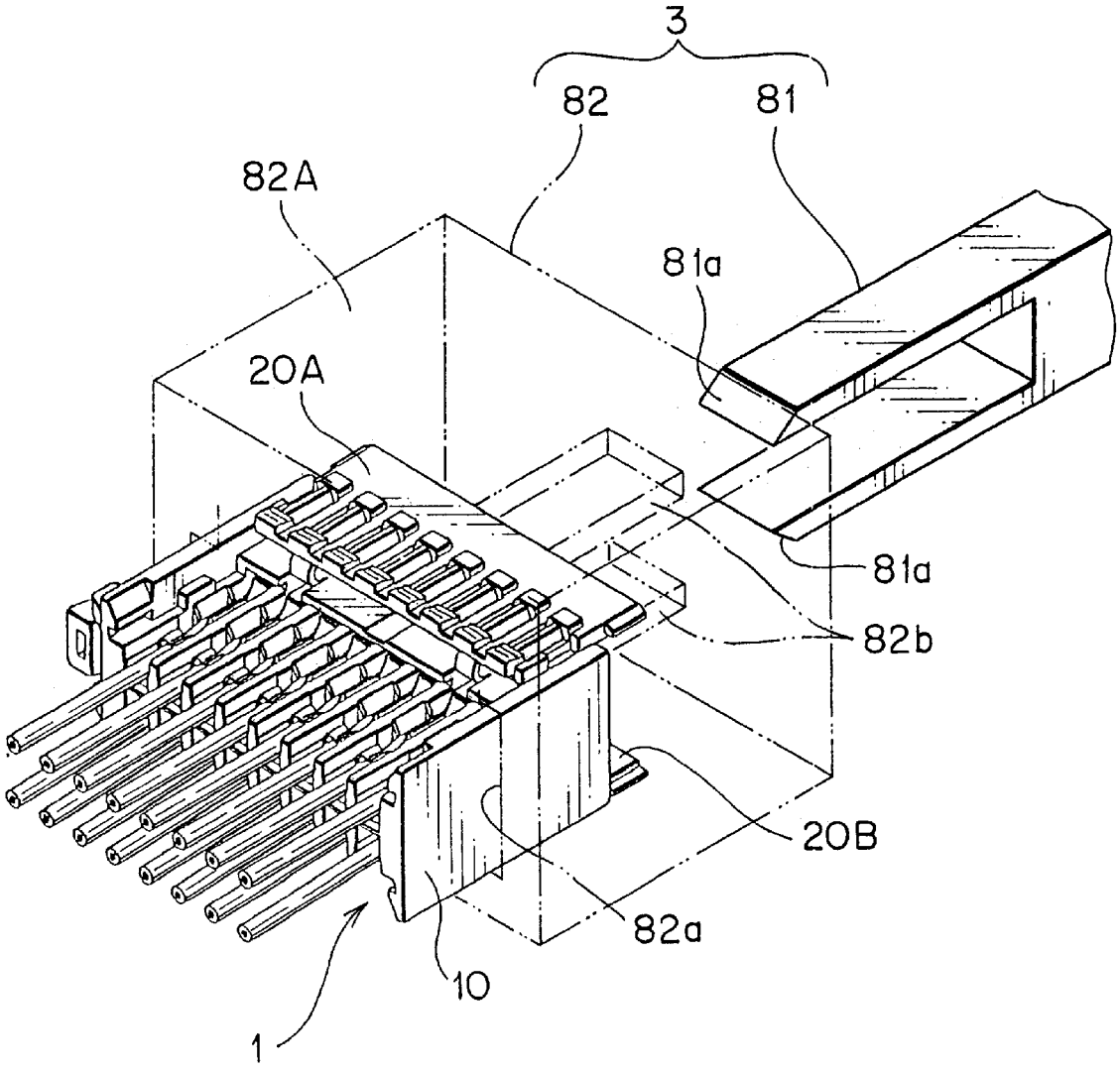
FIG. 6 is a perspective view of the rear holder according to the second embodiment of the present invention.

Referring to FIG. 6, an explanation will be given of the rear holder mounting device according to the second embodiment of the present invention.

FIG. 6 is a perspective view of a rear holder mounting device according to the second embodiment.

In FIG. 6, a rear holder mounting device 3, which serves to mount the rear holder in the connector 1 as described above, includes a cutter 81 and holding block 82.

The cutter 81 has a bifurcated tip of a rod-like body which is vertically symmetrical. The bifurcated tip is provided with cutting blades 81*a* which can be inserted between the rear holders 20A, 20B in an open state and the housing 10.

Figure 2A:
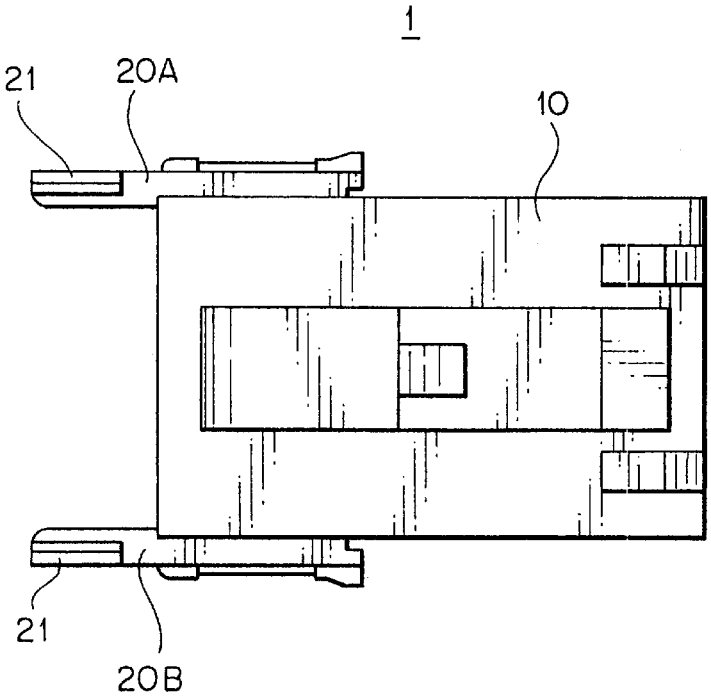
FIGS. 2A and 2B are a side view and a side sectional view of the connector equipped with the rear holder, respectively.
Figure 2B:
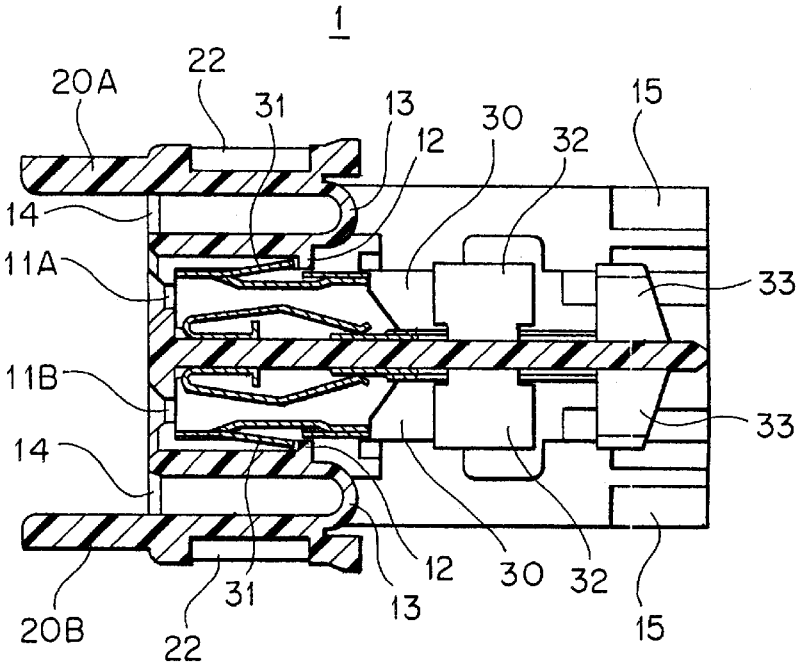

The holding block 82 is a box-shape body having a connector holding space 82*a* in which the connector 1 equipped with the rear holder is held. The box-shape body is provided with insertion holes 82*b* communicating with the connector holding space 82*a*. The cutting blades 81*a* of the cutter 81 inserted in the insertion holes 82*b* can be guided to the fixing belts 14 of the connector 1 (FIGS. 1A and 2B).

In accordance with the rear holder mounting device 3 according to this embodiment, using the holding block 82, the fixing belts 14 and the cutting blades 81*a* can be positioned. The cutter 81 has only to be pushed into the insertion holes 82*b* of the holding block 82 to cut the fixing belts 14 simply and surely.

Thus, the cutting operation of the fixing belts 14 can be automated so that the rear holders 20A and 20B can be easily mounted in the housing 10.

Embodiment 3

An explanation will be given of the rear holder mounting device according to the third embodiment of the present invention.

Figure 7A:
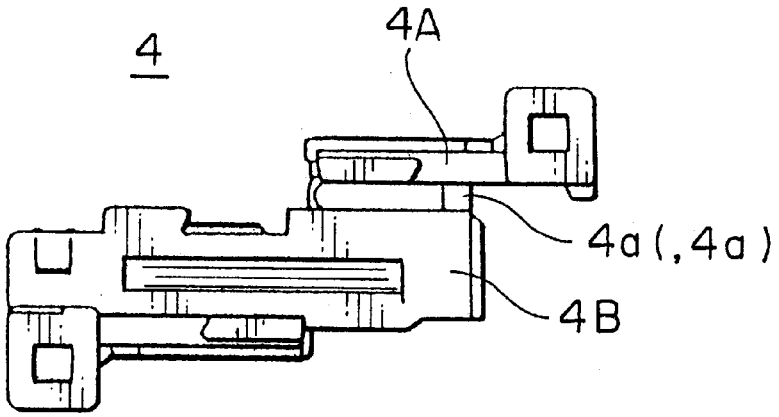
FIG. 7A is a side view of a connector equipped with a rear holder which is an object of a rear holder mounting device according to the third embodiment of the present invention.
Figure 7B:
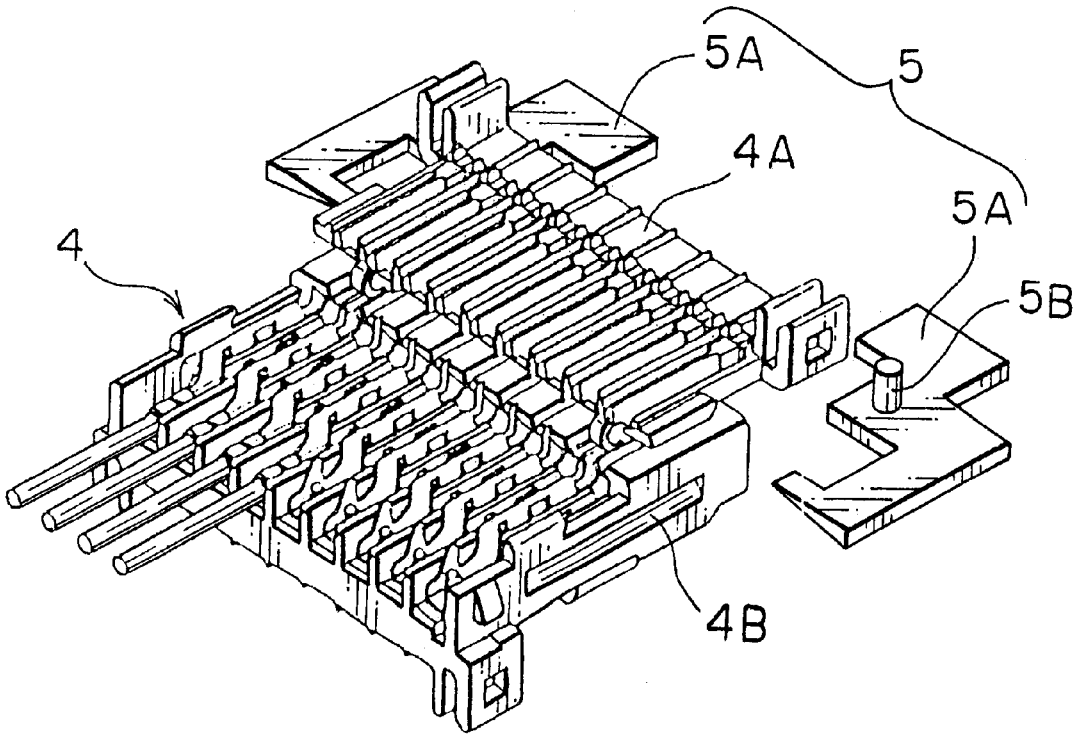
FIG. 7B is a perspective view of the connector equipped with the rear holder and the rear holder mounting device.
Figure 8A:
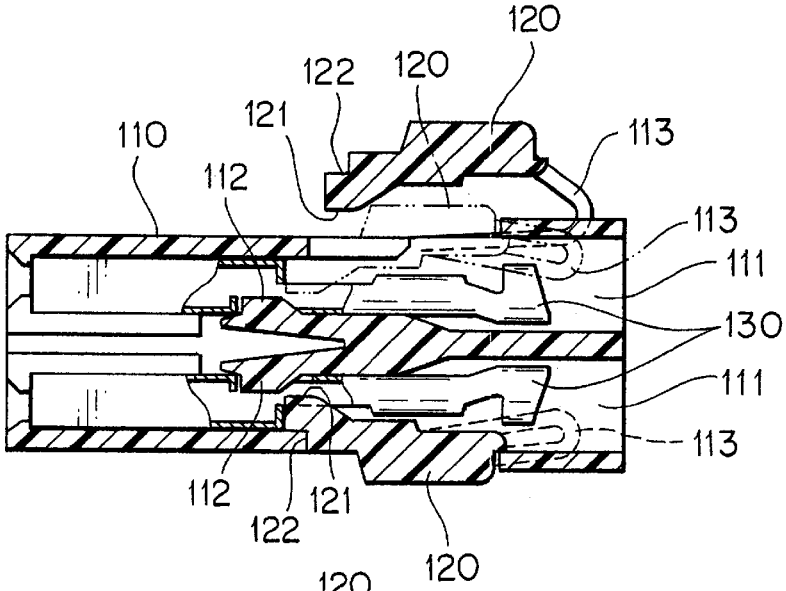
FIG. 8A PRIOR ART
FIGS. 8A, 8B and 8C are a side sectional view, a front view and a side view of the main part of a connector equipped with a rear holder according to a related art, respectively.
Figure 8B:
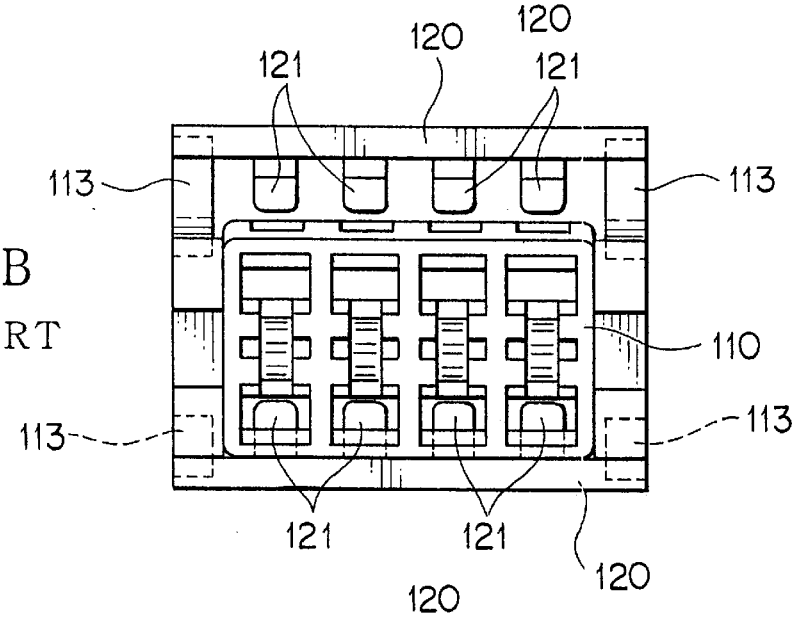
FIG. 8B PRIOR ART
Figure 8C:
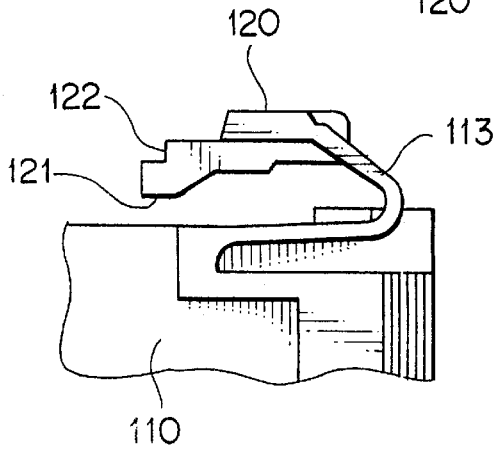
FIG. 8C PRIOR ART

In FIGS. 7A and 7B, the rear holder mounting device 5 serves to mount the rear holder 4A in the connector 4 equipped with a single rear holder 4A on the upper surface. The rear holder mounting device 5 is provided with plate-like cutters 5A for cutting two fixing belts 4*a* for fixing both sides of the rear holder 4A to the housing 4B.

Both cutters 5A are horizontally rotatably supported by rotary shafts 5B, respectively. The cutters 5A are rotated by a driving system (not shown) so that they enter between the rear holder in an open state and the housing 4 to cut the fixing belts 4*a*.

In the rear holder mounting device according to this embodiment also, as in the first and second embodiments, the fixing belts 4*a* can be automatically cut. Thus, the rear holder 4A can be easily mounted in the housing 4B.

What is claimed is:

1. A device for mounting a rear holder in a connector equipped with the rear holder, wherein the connector includes a thin hinge belt for closably coupling the rear holder with a housing, and a fixing belt for coupling the rear holder with the housing in its open state, the fixing belt being formed integrally to the rear holder and housing, said device, comprising:

a cutter for cutting the fixing belt, wherein said cutter is linearly moved to enter between the rear holder in an open state and the housing to cut the fixing belt.

2. A device for mounting a rear holder in a connector equipped with the rear holder, wherein the connector includes a thin hinge belt for closably coupling the rear holder with a housing, and a fixing belt for coupling the rear holder with the housing in its open state, the fixing belt being formed integrally to the rear holder and housing, said devices comprising:

a cutter for cutting the fixing belt wherein said cutter is rotated to enter between the rear holder in an open state and the housing to cut the fixing belt.

3. A device for mounting a rear holder in a connector equipped with the rear holder, wherein the connector includes a thin hinge belt for closably coupling the rear holder with a housing, and a fixing belt for coupling the rear holder with the housing in its open state, the fixing belt being formed integrally to the rear holder and housing, said device, comprising:

a cutter equipped with a cutting blade which can be inserted in between the rear holder in an open state and the housing; and a holding block including a box-shape body having a connector holding space in which the connector equipped with the rear holder is held, said box-shape body being provided with an insertion hole communicating with said connector holding space, whereby said cutting blade can be inserted in said insertion hole and guided to cut the fixing belt of the connector.

4. A device for mounting a rear holder in a connector equipped with the rear holder, wherein the connector includes a thin hinge belt for closably coupling the rear holder with a housing, and a fixing belt for coupling the rear holder with the housing in its open state, the fixing belt being formed integrally to the rear holder and housing, said device, comprising:

a cutter body equipped with a cutting blade which can be inserted in between the rear holder in an open state and the housing; and a pair of frames holding both sides of the connector so that the rear holder is closable and having guide grooves which serve to position said cutting blade on the fixing belt of the connector, and guide sad cutter body retractably for the connector.

5. The device for mounting the rear holder according to claim 4, further comprising a slide bar provided slidably on said cutter body and having a guide slope to be brought into contact with the rear holder.

6. The device for mounting the rear holder according to claim 5, wherein said cutting blade and said slide bar are bifurcated symmetrically vertically.

7. A method for mounting a rear holder in a connector in the device for mounting the rear holder in the connector according to claim 5, comprising the steps of:

holding said connector in said guide grooves and attaching said cutter body to said grooves;

advancing said cutter body along said guide grooves to cut said fixing belt of said connector equipped with said rear holder;

advancing said slide bar to rotate said rear holder in its closing direction; and closing said rear holder to be engaged in said housing.

* * * * *